United States Patent [19]

Paduano, Sr.

[11] Patent Number: 4,995,118

[45] Date of Patent: Feb. 26, 1991

[54] PRE-TIED NECKTIE SET

[76] Inventor: Anthony E. Paduano, Sr., 20 Irvington St., New Haven, Conn. 06513

[21] Appl. No.: 527,343

[22] Filed: May 23, 1990

[51] Int. Cl.[5] ..... A41D 25/00

[52] U.S. Cl. ..... 2/150; 2/148; 2/149; 2/152 R; 2/153

[58] Field of Search ..... 2/150, 148, 149, 152 A, 2/152 R, 153

[56] References Cited

U.S. PATENT DOCUMENTS

| | | | |
|---|---|---|---|
| 2,787,002 | 4/1957 | LaPiedra | 2/153 |
| 3,369,257 | 2/1968 | Less | 2/150 |
| 3,735,420 | 5/1973 | New | 2/150 |
| 3,745,614 | 7/1973 | Tsang | 2/148 |
| 4,000,523 | 1/1977 | Woods | 2/150 |
| 4,173,792 | 11/1979 | Integan | 2/150 |
| 4,337,539 | 7/1982 | Najarian | 2/150 |
| 4,748,692 | 6/1988 | Fukushima | 2/150 |
| 4,875,239 | 10/1989 | Patterson, Jr. | 2/152 R |

*Primary Examiner*—Werner H. Schroeder
*Assistant Examiner*—Gloria Hale
*Attorney, Agent, or Firm*—Terry M. Gernstein

[57] ABSTRACT

A pre-formed support element is shaped to have an uneven surface configuration, and two portions of necktie type cloth are connected to the support to establish an appearance of a knot usually associated with a hand-tied necktie. A drape element includes a stiffener that is releasably attached to the support element and produces an appearance of a hand-tied necktie.

15 Claims, 7 Drawing Sheets

PRE-TIED NECKTIE SET

TECHNICAL FIELD OF THE INVENTION

The present invention relates to the general art of wearing apparel, and to the particular field of neckwear.

BACKGROUND OF THE INVENTION

As is well known, millions of people, both men and women, wear neckties as an adjunct to their clothing. These ties come in a wide variety of colors, patterns and shapes, and are generally divided into two broad classes. Once class of ties is known as the hand-tied tie, another class of ties are pre-tied and are attached by clips or the like to a shirt.

The hand-tied tie is attractive for many reasons, and is quite popular. The hand-tied tie includes a neck-encircling portion and a knot from which depends a drape. The drape can include a vertical groove adjacent to the knot, and this groove is known as a dimple.

While extremely popular, the hand-tied necktie has several drawbacks. Some people, due to handicaps such as arthritis, or some other problem, simply do not have the manual dexterity necessary to tie such ties. Furthermore, safety reasons may dictate that a hand-tied tie is not acceptable. The most visible example of such safety codes is found in police work.

For these and other reasons, some people wear the pre-tied type of ties. Accordingly, the art is replete with various designs for pre-tied ties.

While also extremely popular, most pre-tied ties are not desired by many people for many reasons. For example, such ties often do not look real and the pre-tied nature thereof can be quite readily apparent. Another drawback to such pre-tied ties is the uncomfortable nature thereof right next to a wearer's neck, especially in hot weather. Yet another drawback to such pre-tied ties is their tendency to move out of a desired orientation with respect to the wearer's face and neck.

Still further, such pre-tied ties cannot be easily loosened so a wearer can loosen their shirt collar. The tie must be released from the shirt to unbutton the collar button. This creates several problems, including safety considerations as well as aesthetic considerations.

Still further, both pre-tied and non-tied ties which are presently available, are not amenable to variations in style, appearance and color. That is, one knot is associated with one drape and the only variation with the single tie possible is alteration of the knot style.

Accordingly, there is a need for a pre-tied necktie which looks like a hand-tied tie and has the aesthetic advantages of a hand-tied tie, yet which is comfortable to wear and can be loosened in the manner of a hand-tied tie and which is amenable to a variation in knot/-drape combinations.

OBJECTS OF THE INVENTION

It is a main object of the present invention to provide a pre-tied necktie which looks like a hand-tied tie and has the aesthetic advantages of a hand-tied tie.

It is another object of the present invention to provide a pre-tied necktie which looks like a hand-tied tie and has the aesthetic advantages of a hand-tied tie, yet which is comfortable to wear.

It is another object of the present invention to provide a pre-tied necktie which looks like a hand-tied tie and has the aesthetic advantages of a hand-tied tie, yet which is comfortable to wear and can be loosened in the manner of a hand-tied tie.

It is another object of the present invention to provide a pre-tied necktie which looks like a hand-tied tie and has the aesthetic advantages of a hand-tied tie, yet which is comfortable to wear and can be loosened in the manner of a hand-tied tie and which is amenable to a variation in knot/drape combinations.

SUMMARY OF THE INVENTION

These, and other, objects are achieved by an article of neckwear which includes a specifically sized and shaped support element around which lengths of cloth are wrapped and to which a drape can be removably attached. The drape has a stiffener element which is received in a trough-like opening defined in the support element. The cloth is wrapped about the support element to have the appearance of a Windsor knot or a four-in-hand knot, or the like and has ends which are releasably attached to a shirt beneath the collar or to a strap extending about the wearer's neck.

The tie can also include VELCRO fastener elements on the drape which are attached to a button mounted VELCRO pad.

The pre-tied tie has the look of a hand-tied tie, yet is easy to put on, comfortable and stable after it is put on, yet it can be moved to be loosened. One knot can be worn with several drapes and thus one set is quite versatile.

BRIEF DESCRIPTION OF THE DRAWING FIGURES

DETAILED DESCRIPTION OF THE PREFERRED EMBODIMENT OF THE INVENTION

Figure 2:
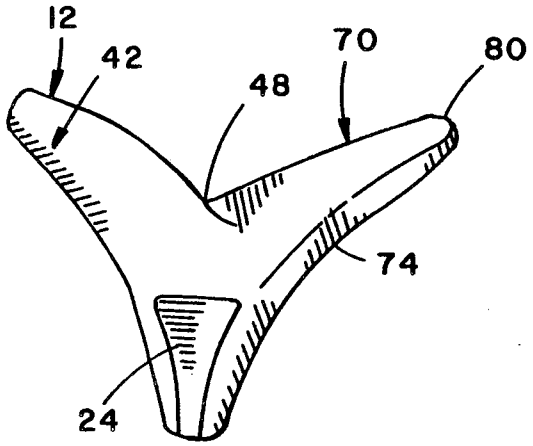
FIG. 2 is a front elevational view of the support element.
Figure 1:
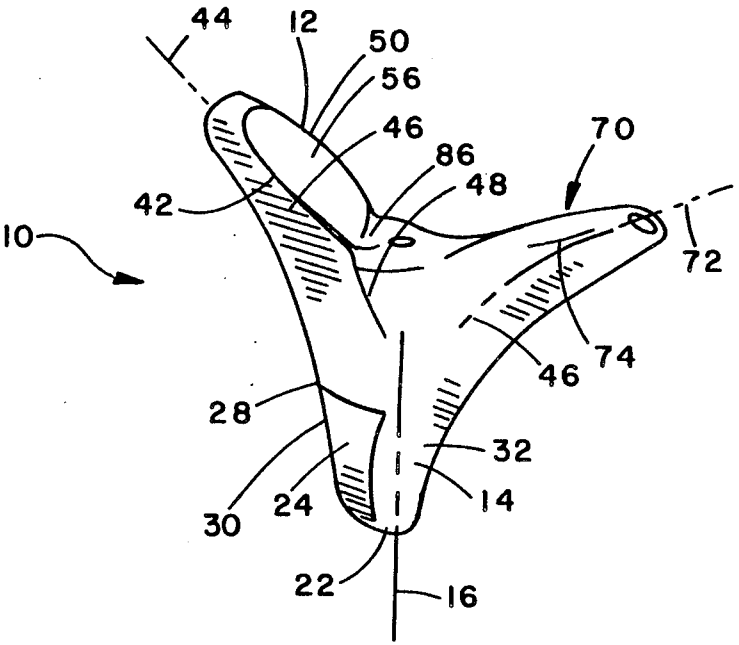
FIG. 1 is a front perspective view of the support element of the present invention.
Figure 5:
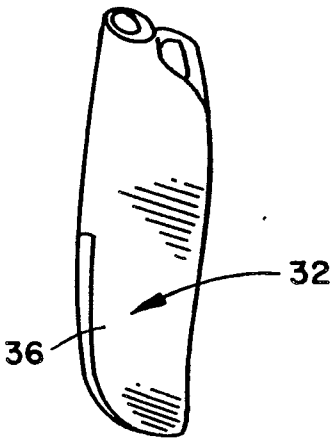
FIG. 5 is a side elevational view of the support element as seen from the side opposite to the side shown in FIG. 4.

Shown in FIGS. 1–7 is a support element 10 for use in a neckwear combination. The support element is manufactured by molding or the like and has a specific shape and contour so that once material is wrapped about that support, it will produce an appearance of a hand-tied knot. Since hand-tied knots are uneven and have several contour discontinuities, the support element 10 has a surface shape and configuration which will produce this uneven appearance. Furthermore, the shape and configuration of the support element 10 is such that when it is located adjacent to a wearer's neck, it will lie in a position that is comfortable and consistent with the manner in which a hand-tied knot will lie.

The support can be formed of any suitable material, even wood or plastic if desired, and can even be hand worked after a molding process if suitable.

Referring to the figures, it is seen that the support element 10 includes a monolithic Y-shaped body 12 having a cylindrical central portion 14 which has a longitudinal centerline 16. The body 12 further includes a front surface portion 18, a rear surface portion 20 and a lower tip 22. The front and rear surface portions are curved, but are curved in different planes and in different areas to produce uneven surface contours when wrapped with cloth of the type generally associated with neckties, such as silk, as well as the various synthetic and natural fabrics and blends well known to those in the neckwear arts.

Figure 7:
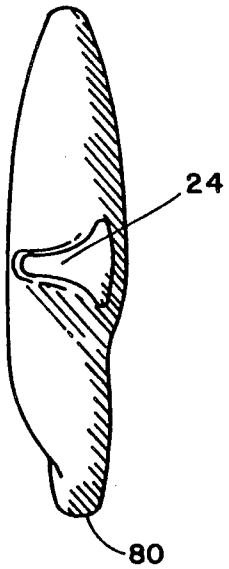
FIG. 7 is a bottom view of the support element.
Figure 6:
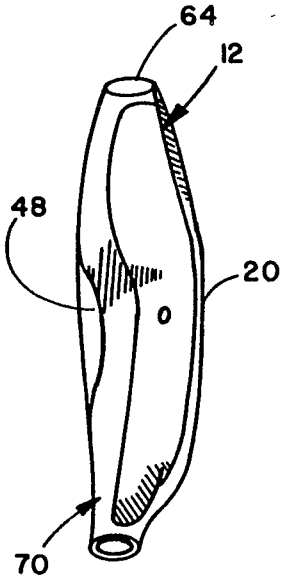
FIG. 6 is a top plan view of the support element.

The support further has a groove 24 defined therein to extend along the longitudinal centerline 16. The groove is roughly C-shaped in cross section to be concave when viewed from the left side of FIG. 1, and extends from the intersection of a lower tip 22 and the rear surface 20 to an upper area 28 of the front surface, and diverges outwardly from the tip 22 as best shown in FIG. 7. The groove 24 will be used to frictionally hold the drape portion of a tie set to a knot portion as will be understood from the ensuing discussion.

The body further includes side surface portions 30 and 32 which connect the front surface portion to the rear surface portion. The side surface portions are also curved about the longitudinal centerline, but with a curvature that is different from the curvature of the front surface and from the rear surface. In fact the areas adjacent to the slot 24 which are designated by reference numerals 34 and 36 are planar. The shape of the sides, the front and the rear are such that the tie knot will have a proper appearance when wrapped with cloth.

The support further includes a wing section 40 which extends upward from the upper area 28. The wing section 40 includes a first wing 42 that extends at a skewed angle with respect to the longitudinal centerline 16 upwardly from the lower tip 22 to form one leg of the Y-shape of the body.

The first wing 42 includes a longitudinal axis 44 and a front surface 46 which is curved about the axis 44 and which intersects the central portion front surface near the top of the slot 24. The front surface of the first wing 42 has a curvature that is different from the curvature of the central section front surface adjacent to the slot so that a rounded shoulder 48 that extends at an angle that is skewed with respect to the longitudinal centerline 16 and also with respect to the longitudinal axis 44 is formed at the intersection of the first wing front surface and the central portion front surface. The curvatures of the central portion and the first wing are such that the rounded shoulder is convex with respect to the surfaces.

Figure 4:
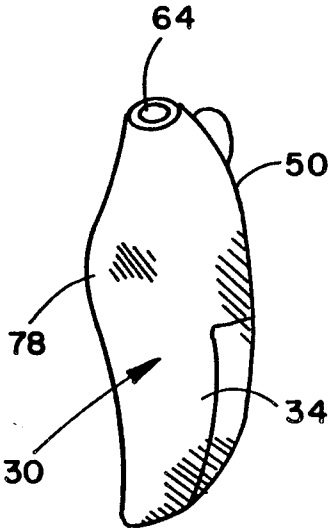
FIG. 4 is a side elevational view of the support element.
Figure 3:
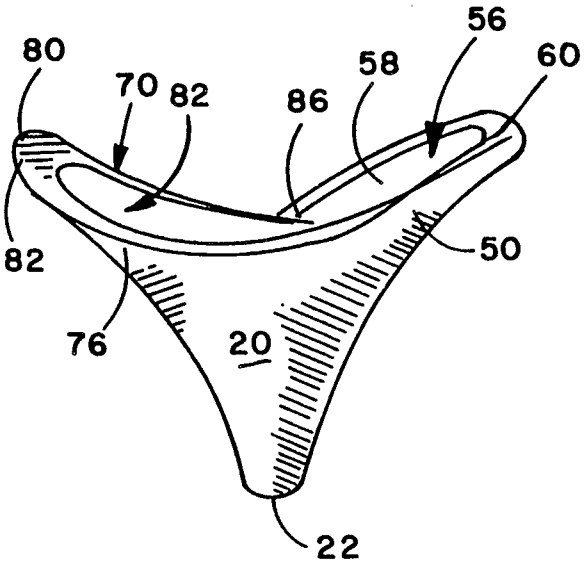
FIG. 3 is a rear perspective view of the support element.

The first wing also includes a rear surface 50 that is rounded about the longitudinal axis 44 and is rounded in a plane that is different from the plane in which the central portion rear surface 20 is curved. This causes the rear of the first wing to bulge outwardly as shown in FIG. 4.

The first wing 42 also includes a top surface 56 which slopes downwardly towards the lower tip 22 from the front surface to the rear surface. This slope will permit the tie knot to lie at an angle that is proper so the tie is comfortable when worn.

A groove 58 is defined in the first wing top surface from adjacent to an outer tip 60 and extends along the longitudinal axis 44. The groove 58 is concave in shape with respect to the top surface and will provide a seat for the cloth used in the knot so the knot will have a proper look and feel and will lie properly when worn.

The first wing also includes a concave dimple 64 on the outermost tip thereof. The dimple also causes the cloth to lie on the support in a proper and desired manner to produce an effect of a hand-tied knot.

The support also includes a second wing 70 which also includes a longitudinal axis 72 that is skewed with respect to the axis 44 and with respect to the axis 16 and lies in a plane that is different from those two axes which are in planes different from each other. The second wing also includes a front surface 74 that is curved about the axis 72 with a curvature that differs from the curvature of the first wing front surface and which intersects that first wing front surface at the rounded shoulder 48. The second wing also has a rear surface 76 that is curved about the longitudinal axis 72 in a plane and with a curvature that is identical to the plane and curvature of the rear surface 50 of the first wing. Both the rear surfaces 50 and 76 bulge slightly outward from the central portion rear surface as indicated in FIG. 4 by reference number 78.

The second wing has an outer tip 80 which has a dimple 82 defined therein. The dimple is concave and serves the same purpose as the dimple 64. The second wing also includes a top surface 82 that slopes downwardly towards the lower tip 22 and connects the second wing rear surface to the second wing front surface. The second wing top surface slopes from the tip 80 inwardly towards the central body centerline 16 at a skewed angle that differs from the slope of the first wing top surface so the two top surfaces meet at a shoulder 86. The shoulder 86 is near the shoulder 48 and slopes rearwardly and downwardly therefrom.

Figure 9:
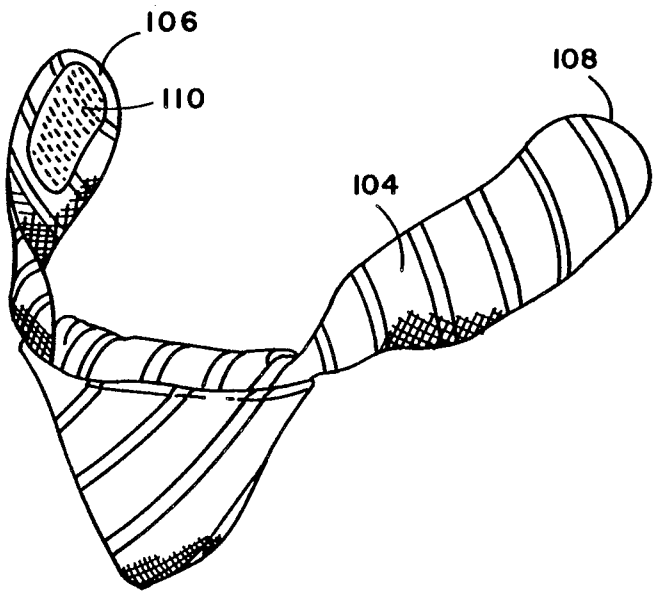
FIG. 9 is a front perspective view of a knot portion of the tie set of the present invention.
Figure 8:
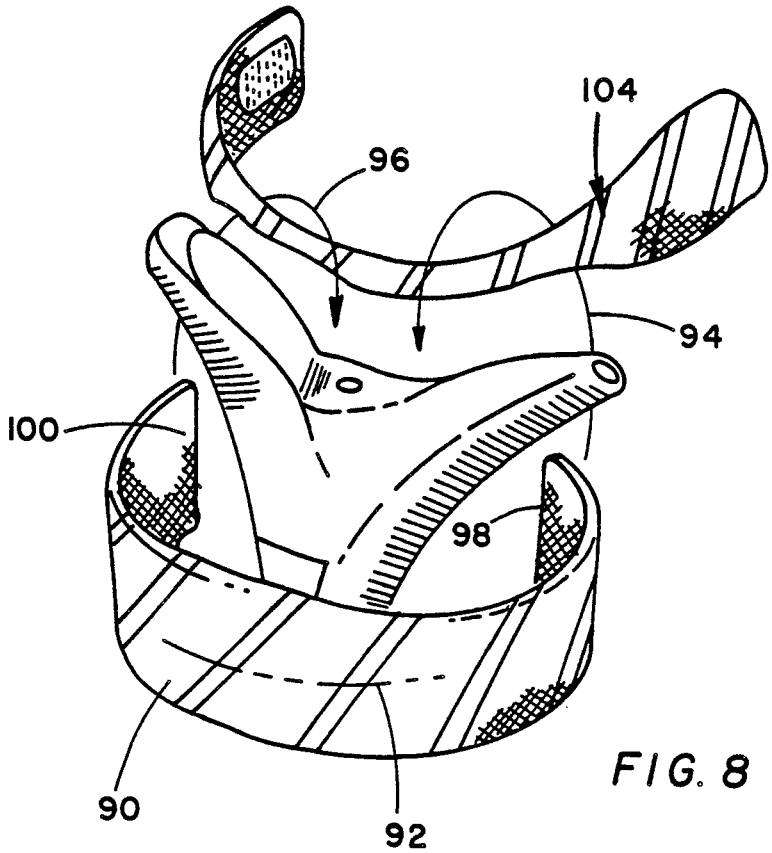
FIG. 8 is an exploded perspective view showing the cloth being wrapped about the support element to produce a knot portion of a tie set.

As shown in FIGS. 8 and 9, the knot is prepared by wrapping a first section 90 of neckwear cloth about the central body section in a manner such that the longitudinal centerline 92 of the cloth section 90 is oriented transversely of the central portion longitudinal centerline 16. The first cloth section is wrapped around the central portion as indicated by the arrows 94 and 96 with ends 98 and 100 being wrapped around the wing section and pulled down in front of the support element beneath the body portion of the cloth section. The wrapping process is similar to that used to tie a Windsor or a four-in-hand knot and thus will not be further discussed.

As indicated in FIG. 8, a second portion 104 of cloth suitable for use in neckwear, is placed on top of the support element to be forced into the grooves defined in the top surface of the wing sections. The second cloth portion is placed against the support element and the first section of cloth is then wrapped thereabout as above discussed. This produces a pre-tied knot that has an exact appearance of a hand-tied knot as shown in FIG. 9. The slot 24 is closed across the rear surface but is open from the lowermost tip 22. The slot thus covered will form a pocket, the purpose of which will be discussed below.

As is also shown in FIG. 9, the second section of cloth material has ends 106 and 108 and fastener material, such as material 110, is located thereon near such ends. The use of such fastener materials will be evident from the ensuing discussion.

Figure 10:
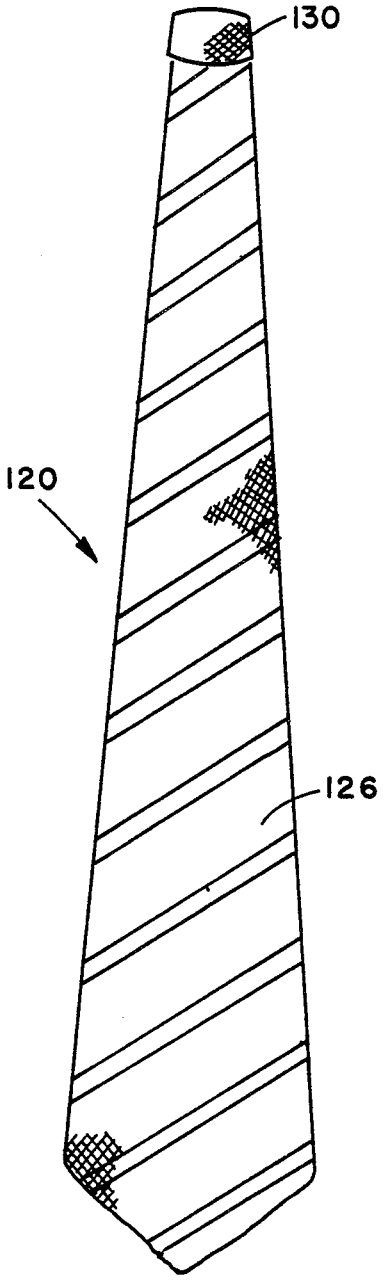
FIG. 10 is a front elevational view of a drape portion of the tie set.
Figure 11:
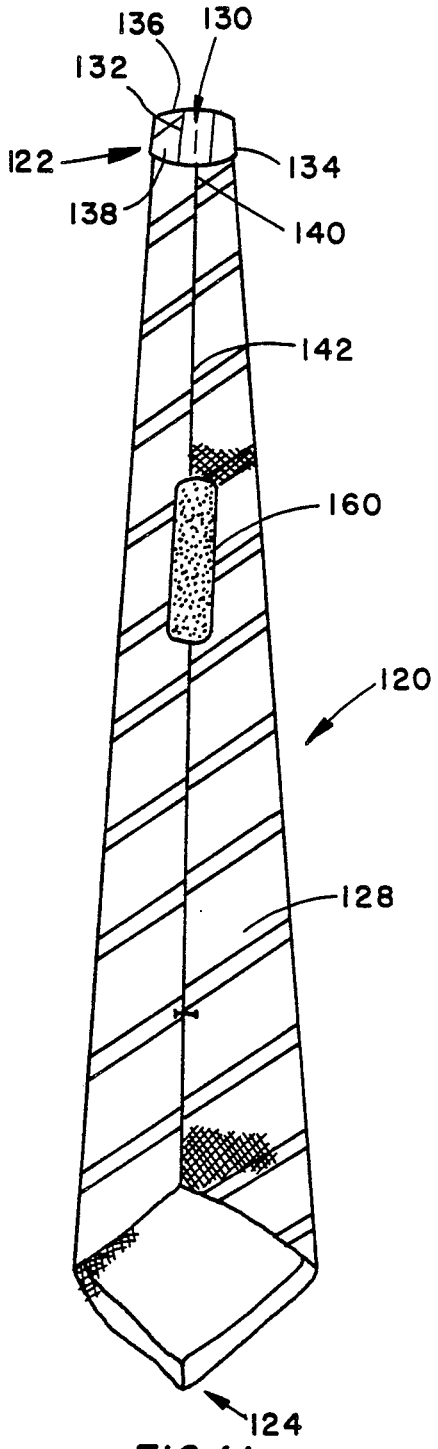
FIG. 11 is a rear elevational view of the drape portion.

The drape portion 120 of the neckwear set is shown in FIGS. 10 and 11 as including a top 122 and a bottom 124, a front surface 126 and a rear surface 128. The drape 120 also includes a stiffener element 130, such as plastics-type material having thinned sections 132 and 134 that extend from the top edge 136 thereof to the bottom edge 138 thereof. The thinned portions form living hinges so the stiffener element can be rotated about the longitudinal centerline 140 thereof. The plastics-type material has a material memory, so that once deformed, it will tend to return to its undeformed state and configuration. The longitudinal centerline of the stiffener is aligned with the longitudinal centerline 142 of the drape 120.

Figure 12:
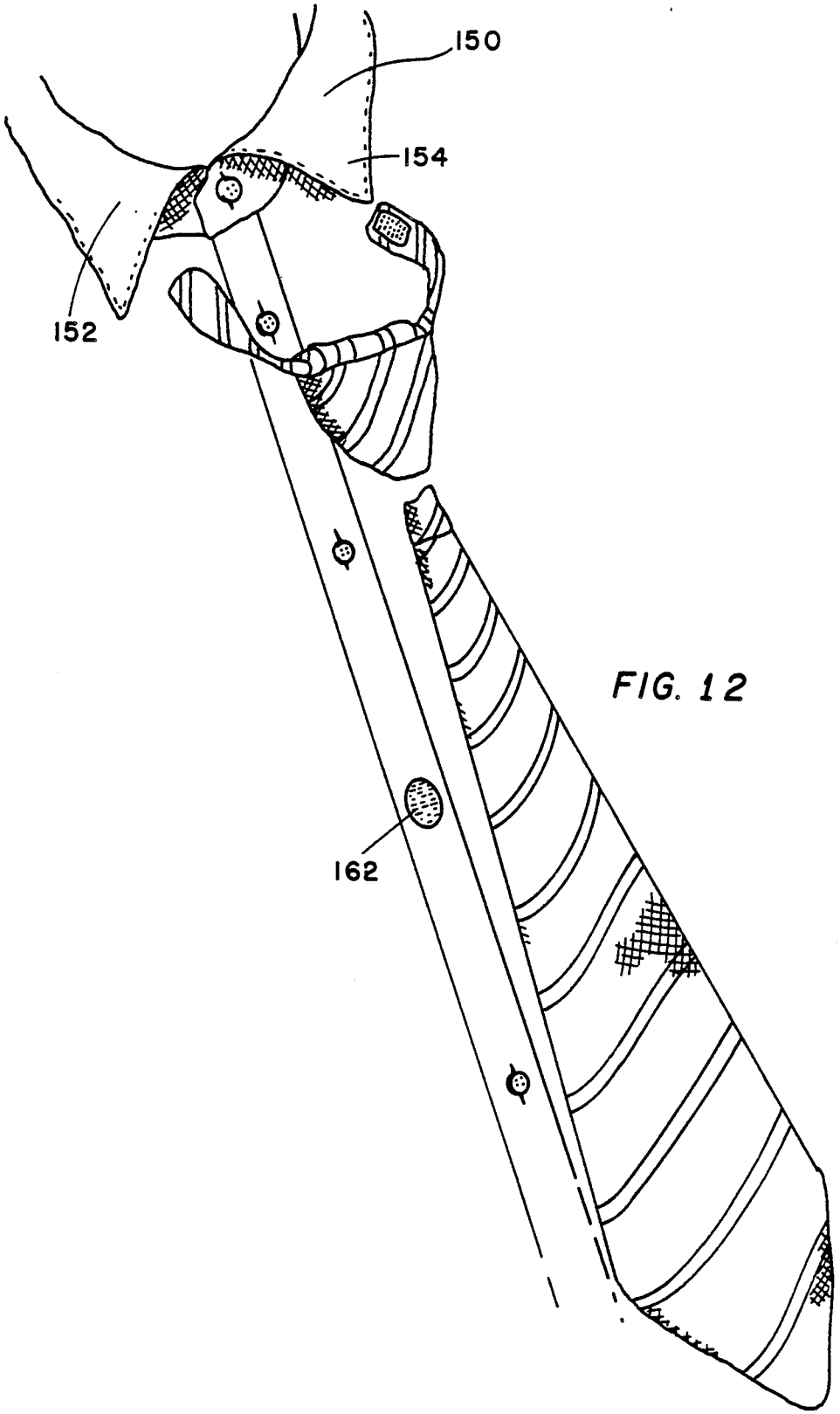
FIG. 12 is an exploded front perspective view of the tie set of the present invention in conjunction with a shirt and a shirt collar.
Figure 13:
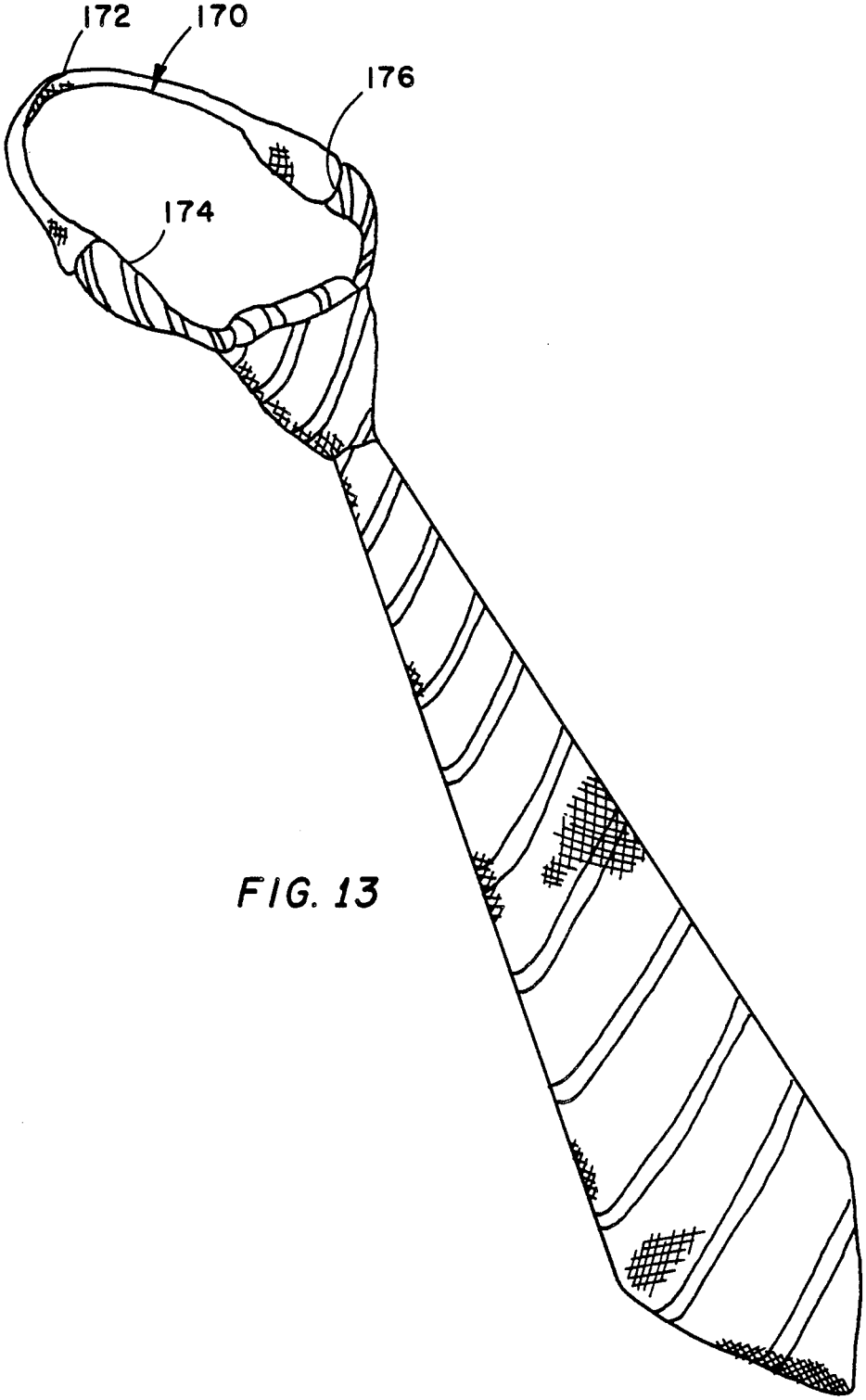
FIG. 13 is a front perspective of a tie set in conjunction with a neck strap which encircles a wearer's neck beneath the collar of a shirt to hold the tie in place.

The top 122 of the drape is rolled up about the longitudinal centerline of the stiffener and forced into the pocket formed by the covered slot. The natural resilience of the plastic stiffener will force that stiffener against the central body adjacent to the slot and create a friction fit between the drape and the knot. The forcing of the stiffener into the pocket will form a dimple in the drape subadjacent to the knot in the manner of a hand-tied necktie. The thus assembled neck tie set is attached to fastener material located on the shirt of the wearer as indicated in FIG. 12 by attaching the fastener material 106 on the second section of cloth to co-operating fastener materials 150 and 152 located on the shirt beneath the collar 154. FIG. 12 also indicates the assembly of the neck tie set. As can be seen in the figures, any pattern appearing on the knot portion of the set can be matched to any pattern appearing on the drape portion of the set. Thus, for example, if the pattern is stripes as shown, the stripes on the knot portion can be oriented to run in the same direction as the stripes on the drape portion. Many hand-tied ties do not permit such pattern matching.

The drape also includes a fastener element 160 attached to the rear surface 128 thereof. A co-operating fastener element 162 is mounted on a button of the shirt and releasably engages with the drape-mounted fastener element to hold the drape in position on the wearer's shirt. VELCRO, or other such hook-and-loop fastener material, is a suitable material for all of the fastener elements associated with the neck tie set of the present invention.

If a shirt does not have the fastener elements 150 and 152, a strap element 170 can be used. The strap element 170 has a body 172 that fits around a wearer's neck beneath the collar of his shirt, and has fastener material thereon near the ends 174 and 176 thereof. The fastener material on the strap is similar to the above-discussed fastener material, and releasably attaches the neck tie set to the strap.

It is understood that while certain forms of the present invention have been illustrated and described herein, it is not to be limited to the specific forms or arrangements of parts described and shown.

I claim:

1. A support element for use in a neckwear combination comprising:

a monolithic Y-shaped body having (1) a cylindrical central portion which includes
- (a) a longitudinal centerline,
- (b) a front surface portion,
- (c) a rear surface portion,
- (d) a lower tip,
- (e) an upper area spaced from said lower tip,
- (f) a C-shaped slot extending along said central portion longitudinal centerline from said lower tip adjacent to said rear surface portion to adjacent to said upper area in said front surface portion, said slot being concave,
- (g) side surface portions connecting said rear surface portion to said front surface portion, and
- (h) all of said surface portions being curved around said longitudinal centerline, with said side surface portions having similar curvatures which are different from the curvature of said front surface portion which is different from the curvature of said rear surface portion, with said side surface portions being planar adjacent to said slot, (2) a wing section extending from said body central portion upper area and including (a) a first wing extending at a skewed angle with respect to said central portion longitudinal centerline and extending upwardly from said lower tip and which includes
- (i) a longitudinal axis which extends at an angle that is skewed with respect to said central body longitudinal centerline and which is in a plane different from a plane containing said central body longitudinal centerline,
- (ii) an outer tip,
- (iii) a front surface which is located adjacent to said central body portion front surface and which is curved about said first wing longitudinal centerline, said first wing front surface merging with said central body front surface and having a curvature that is different from the curvature of said central body front surface curvature and intersecting said central body front surface to form a rounded shoulder which extends at a skewed angle with respect to said central body longitudinal centerline,
- (iv) a rear surface which has a curvature about said first wing longitudinal centerline, said first wing rear surface being in a plane that is different from a plane containing said central body rear surface,
- (v) a top surface which slopes downwardly toward said central body lower tip from said first wing front surface to said first wing rear surface,
- (vi) a concave dimple defined in said first wing outer tip,
- (vii) a concave groove defined in said first wing top surface from adjacent to said outer tip and extending along said first wing longitudinal centerline, (b) a second wing extending at a skewed angle with respect to said central portion longitudinal centerline and extending upwardly from said lower tip and which includes
- (i) a longitudinal axis which extends at an angle that is skewed with respect to said central body longitudinal centerline and which is in a plane different from a plane containing said central body longitudinal centerline and which is skewed with respect to said first wing longitudinal centerline and in a plane that is different from the plane containing said first wing longitudinal centerline, (ii) an outer tip, (iii) a front surface which is located adjacent to said central body portion front surface and which is curved about said second wing longitudinal centerline, said second wing front surface merging with said central body front surface and having a curvature that is different from the curvature of said central body front surface curvature and different from the curvature of said first wing front surface and intersecting said central body front surface at said rounded shoulder, (iv) a rear surface which has a curvature about said second wing longitudinal centerline, said second wing rear surface being in a plane that is different from a plane containing said central body rear surface and forming a continuation of said first wing rear surface, (v) a top surface which slopes downwardly toward said central body lower tip from said second wing front surface to said second wing rear surface, said second wing top surface having a curvature which is different from said first wing top surface curvature and intersecting said first wing top surface to form a top surface shoulder which extends at a skewed angle with respect to said rounded shoulder and which is located in a plane that is different from a plane containing said rounded shoulder, (vi) a concave dimple defined in said second wing outer tip, (vii) a concave groove defined in said second wing top surface from adjacent to said second wing outer tip and extending along said second wing longitudinal centerline.

2. An article of clothing comprising:

(A) a support element as defined in claim 1;

(B) a first portion of cloth on said support element top surfaces;

(C) a second portion of cloth wrapped about said support element and about said first portion of cloth.

3. The article of clothing defined in claim 2 further including fastening means on said necktie and cooperating fastening means on a shirt.

4. The article of clothing defined in claim 3 wherein said fastening means includes hook-and-loop fastening means.

5. The article of clothing defined in claim 2 further including a strap which is to be worn around a shirt collar, said strap including fastening means.

6. The article of clothing defined in claim 2 wherein said first portion of cloth is wrapped about said support element in the form of a Windsor knot.

7. The article of clothing defined in claim 2 wherein said first portion of cloth covers the C-shaped slot and forming a pocket in said support element

8. The article of clothing defined in claim 7 further including a drape element releasably attached to said support element.

9. The article of clothing defined in claim 8 wherein said drape element includes a stiffener element which is frictionally received in said pocket.

10. The article of clothing defined in claim 9 wherein said drape element further includes a fastener element mounted thereon.

11. The article of clothing defined in claim 10 further including a second fastener element on the shirt in position to cooperate with the fastener element on said drape.

12. The article of clothing defined in claim 11 wherein said stiffener element in said drape includes a body formed of plastic material.

13. The article of clothing defined in claim 12 wherein said stiffener body includes two weakened areas which form living hinges in said stiffener body.

14. The article of clothing defined in claim 13 wherein said stiffener body material has a material memory.

15. The article of clothing defined in claim 2 wherein said first portion of cloth is wrapped about said support element in the form of a four-in-hand knot.

* * * * *